US006259882B1

(12) United States Patent
Lindblad et al.

(10) Patent No.: US 6,259,882 B1
(45) Date of Patent: Jul. 10, 2001

(54) CLEANING BRUSH FOR NON-IMAGING SURFACES IN AN ELECTROSTATOGRAPHIC PRINTER OR COPIER

(75) Inventors: Nero R. Lindblad, Ontario; James M. Casella; James C. Diehl, both of Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/448,972

(22) Filed: Nov. 24, 1999

(51) Int. Cl.[7] ..... G03G 21/00
(52) U.S. Cl. ..... 399/352; 399/353; 399/354
(58) Field of Search ..... 399/99, 162–165, 399/352–354; 15/256.5–256.52

(56) References Cited

U.S. PATENT DOCUMENTS 4,457,615 * 7/1984 Seanor ..... 399/354 X
4,853,741 8/1989 Ku .
5,394,224 * 2/1995 Irobe ..... 399/99
5,655,205 8/1997 Ziegelmuller et al. ..... 399/350
5,784,674 * 7/1998 Iseki et al. ..... 399/354 X
5,797,078 * 8/1998 Sass et al. ..... 399/353 X
6,016,415 * 1/2000 Herrick et al. ..... 399/162

* cited by examiner

*Primary Examiner*—William J. Royer
(74) *Attorney, Agent, or Firm*—L. M. Robb

(57) ABSTRACT

An apparatus for removing electrostatically charged particles from a surface such as the backside of an image bearing belt of the type found in an electrostatographic printing apparatus or a drive roller supporting an image bearing belt. The apparatus includes an electrically biased brush having a substrate and a multiplicity of conductive fibers extending outwardly to contact the surface to be cleaned, a supporting device, and a cleaning device for removing collected particles from the brush. The supporting device for the brush rotates, thereby moving the brush and causing clean fibers to contact the surface to be cleaned.

16 Claims, 4 Drawing Sheets

CLEANING BRUSH FOR NON-IMAGING SURFACES IN AN ELECTROSTATOGRAPHIC PRINTER OR COPIER

BACKGROUND OF THE INVENTION

This invention relates generally to an electrostatographic printer or copier, and more particularly concerns a device for cleaning the backside of a photoreceptor belt used therein.

In an electrophotographic application such as xerography, a charge retentive surface (ie., photoconductor, photoreceptor or imaging surface) is electrostatically charged and exposed to a light pattern of an original image to be reproduced to selectively discharge the surface in accordance therewith The resulting pattern of charged and discharged areas on that surface form an electrostatic charge pattern (an electrostatic latent image) conforming to the original image. Contacting it with a finely divided, electrostatically attractable powder referred to as "toner" develops the latent image. Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. This process is well known, and useful for light lens copying from an original and printing applications from electronically generated or stored originals, where a charged surface may be image-wise discharged in a variety of ways. Ion projection devices where a charge is image-wise deposited on a charge retentive substrate operate similarly.

One type of charge retentive surface typically utilized in the electrostatographic reproduction device is a photoreceptor belt having a base of flexible material The photoreceptor belt is entrained about a plurality of support rollers so as to form a closed loop path. The photoreceptor belt is driven about the closed loop path to present particular areas of the photoreceptor belt sequentially into association with electrographic process stations to form desired reproductions. Adhered to the backside of the photoreceptor belt is a substrate polycarbonate known as anti-curl back coating. The purpose of this coating is to balance the stresses within the photoreceptor belt and control edge curling. Over time as a photoreceptor belt repeatedly travels around the sharp corners of rollers, backer bars, and other surfaces, the anti curl back coating begins to wear and flake off in the form of low charged negative particles. As a result, a build up of anti-curl back coating particles occurs on all parts of the module which come in contact with the anti-curl back layer. Additionally, toner particles from the development system, the imaging surface cleaner, and toner airborne in the xerographic module are deposited on the back of the belt. In particular, there is a buildup of anti-curl back coating particles and toner particles on the drive roller, the backer bars, and in the Acoustic Transfer Assist (ATA) device. Debris particles on the drive roll cause the coefficient of friction of the drive roller to drop appreciably. This buildup of particles on the backside of the photoreceptor belt and drive roller may adversely affect performance of the photoreceptor belt as it is driven about the closed loop path and, ultimately, overall performance of the reproduction apparatus. In a non-contact development system, such as Hybrid Scavengeless Development (HSD), the spacing between the developer and the imaging surface is important. When debris builds up on the developer backer bars, the photoreceptor is lifted off the backer bars, causing the spacing in the development nip to decrease. When this occurs in a particular location, or several different locations on the developer backer bars, the different development fields produce streaks on copy in the process direction. Excessive debris in the ATA reduces the suction pressure in the ATA and creates transfer defects.

Several mechanisms have been employed for cleaning the backside of the photoreceptor belt. One mechanism includes a stationary pad of a material such as cotton. This pad can easily become saturated with debris, with the period of time required for the pad to become saturated not readily predictable. Saturation of the pad can cause excessive abrasion and scratching of the photoreceptor belt, necessitating frequent inspection and cleaning. To meet high volume copier applications, a cleaner for the backside of a photoreceptor belt or the drive roller is needed that would preserve drive capacity and prevent anti curl back coating contamination to sensitive subsystems.

The following disclosures may be relevant to various aspects of the present invention and may be briefly summarized as follows:

U.S. Pat. No. 4,853,741 to Ku utilizes an indexing web of material, such as a fabric of a non-woven blend of polyester and rayon for example. The web is periodically indexed by a motor, which is coupled to the mechanism. While this mechanism reduces the necessity for frequent inspection, it may scratch the dielectric support web if it picks up any abrasive particles or debris.

U.S. Pat. No. 5,655,205 to Ziegelmuller et al. discloses a mechanism for cleaning the backside of an image bearing dielectric support web including a cleaning blade which engages the backside of the dielectric support web at a predetermined angle so as to wipe the backside of the web. A catch tray attached to the blade collects debris removed from the backside of the web.

SUMMARY OF THE INVENTION

Briefly stated, and in accordance with one aspect of the present invention, there is provided an apparatus for removing electrostatically charged particles from a surface. The apparatus includes an endless electrically biased conductive flexible belt brush having a substrate from which conductive fibers extend outwardly, rollers about which the belt brush is entrained, and a cleaning device for cleaning collected particles from the brush belt. One of the rollers supporting the brush belt is a drive roller which rotates, thereby moving the brush belt and causing clean fibers to contact the surface to be cleaned.

In accordance with another aspect of the present invention, there is provided an electrically biased conductive cylindrical brush having a substrate from which conductive fibers extend outwardly, a cylindrical core about which the substrate is entrained, and a cleaning device for cleaning collected particles from the cylindrical brush. The cylindrical core supporting the cylindrical brush rotates, thereby causing clean fibers to contact the surface to be cleaned.

In accordance with yet another aspect of the present invention, there is provided a printing machine of the type having a photoconductive member in the form of an image bearing belt and an apparatus for removing particles which accumulate on the backside of the image bearing belt or the drive roller supporting the image bearing belt. The apparatus for removing accumulated particles includes an electrically biased brush belt, which contacts the surface to be cleaned, and which is supported by a plurality of rollers, one of which is a drive roller, and a cleaning device to remove particles collected by the brush belt. The drive roller for the brush belt rotates, thereby moving the brush belt to bring clean fibers into contact with the backside of the image bearing belt or the drive roller supporting the image bearing belt.

BRIEF DESCRIPTION OF THE DRAWINGS

The foregoing and other features of the instant invention will be apparent and easily understood from a further reading of the specification, claims and by reference to the accompanying drawings in which:

While the present invention will be described hereinafter in connection with a preferred embodiment thereof, it should be understood that it is not intended to limit the invention to that embodiment. On the contrary, it is intended to cover all alternatives, modifications and equivalents as may be included within the spirit and scope of the invention as defined in the appended claims.

DETAILED DESCRIPTION OF THE INVENTION

Figure 1:
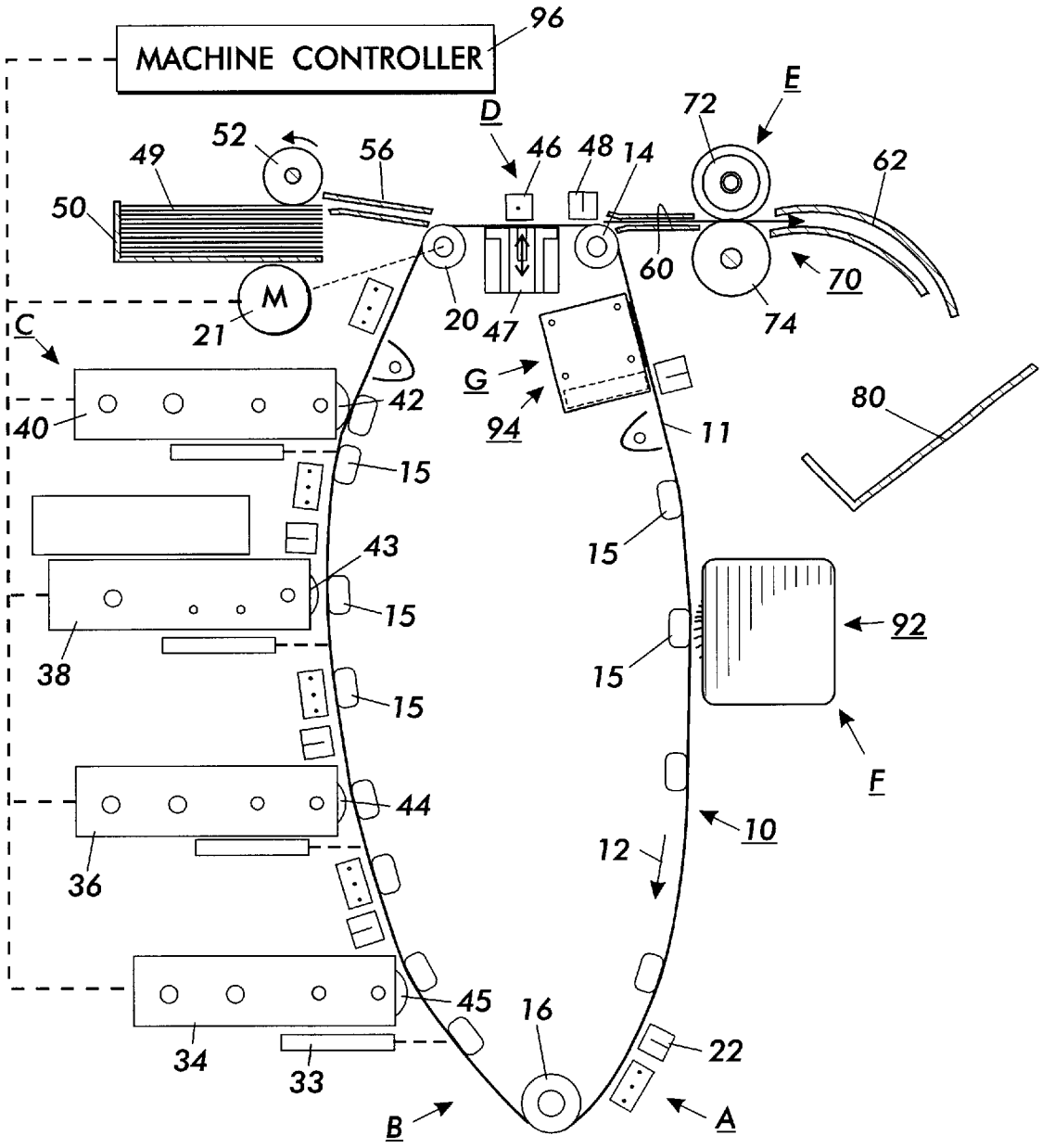
FIG. 1 is a schematic illustration of a printing apparatus incorporating the inventive features of the present invention

For a general understanding of an electrophotographic printer or copier, in which the present invention may be incorporated, reference is made to FIG. 1, which depicts schematically the various components thereof. Hereinafter, like reference numerals have been used throughout to identify identical elements. Although the brush belt cleaner apparatus of the present invention is particularly well adapted for use in an electrophotographic printing machine, it should become evident from the following discussion that it is equally well suited for use in other applications and is not necessarily limited to the particular embodiment shown herein.

Referring now to the drawings, the various processing stations employed in the reproduction machine illustrated in FIG. 1 will be described briefly hereinafter. It will no doubt be appreciated that the various processing elements also find advantageous use in electrophotographic printing applications from an electronically stored original, and with appropriate modifications, to an ion projection device which deposits ions and image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance portions of the belt 10 sequentially through the various processing stations disposed about the path of movement thereof. The belt 10 is entrained about a stripping roller 14, a tension roller 16, a drive roller 20, and backer bars indicated generally as 15. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers, which rotate freely as the belt 10 moves in the direction of arrow 12.

With continued reference to FIG. 1, initially a portion of the belt 10 passes through charging station A. At charging station A, a corona device 22 charges a portion of the photoreceptor belt 10 to a relatively high, substantially uniform potential, either positive or negative. At exposure station B, a Raster Output Scanner (ROS) 33 exposes the charged portions of photoreceptor belt 10 to record an electrostatic latent image thereon.

Thereafter, the belt 10 advances the electrostatic latent image to developing station C. At developing station C, developer housings 34, 36, 38, or 40 are brought into contact with the belt 10 for the purpose of developing the electrostatic latent image. Each developer housing 34, 36, 38, and 40 supports a developing system such as magnetic brush rolls 42, 43, 44, and 45, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10.

The photoreceptor belt 10 then advances the developed image to transfer station D. At transfer station D, a sheet of support material such as paper copy sheets is advanced into contact with the developed images on the belt 10. A corona generating device 46 charges the copy sheet to the proper potential so that it becomes tacked to the photoreceptor belt 10 and the toner powder image is attracted from the photoreceptor belt 10 to the sheet Acoustic Transfer Assist device 47 provides vibrational energy to photoreceptor belt 10 at a frequency sufficient to assist in loosening the toner powder image and thereby facilitating transfer of the image to the sheet. After transfer, the corona generator 48 charges the copy sheet to an opposite polarity to de-tack the copy sheet from the belt 10, whereupon the sheet is stripped from the belt 10 at stripping roller 14.

Sheets of support material 49 are advanced to transfer station D from a supply tray 50. Sheets are fed from tray 50, with sheet feeder 52, and advanced to transfer station D along conveyor 56.

After transfer, the sheet continues to move in the direction of arrow 60, to fusing station E. Fusing station E includes a fuser assembly indicated generally by the reference numeral 70, which permanently affixes the transfer toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a chute 62 to an output 80 or finisher.

Residual particles, remaining on the image side of photoreceptor belt 10 after each copy is made, may be removed at cleaning station F, represented by the reference numeral 92. At cleaning station 92 residual toner particles are removed and may also be stored for disposal.

Residual particles, collecting on the backside of photoreceptor belt 10, may be removed at back of belt cleaning station G. The cleaning apparatus of the present invention is represented by the reference numeral 94, which will be described in greater detail in FIGS. 2–4. Removed residual particles may also be stored for disposal A machine controller 96 is preferably a known programmable controller or combination of controllers, which conventionally control all of the machine steps and functions described above. The controller 96 is responsive to a variety of sensing devices to enhance control of the machine, and also provides connection diagnostic operations to a user interface (not shown) where required.

Figure 2:
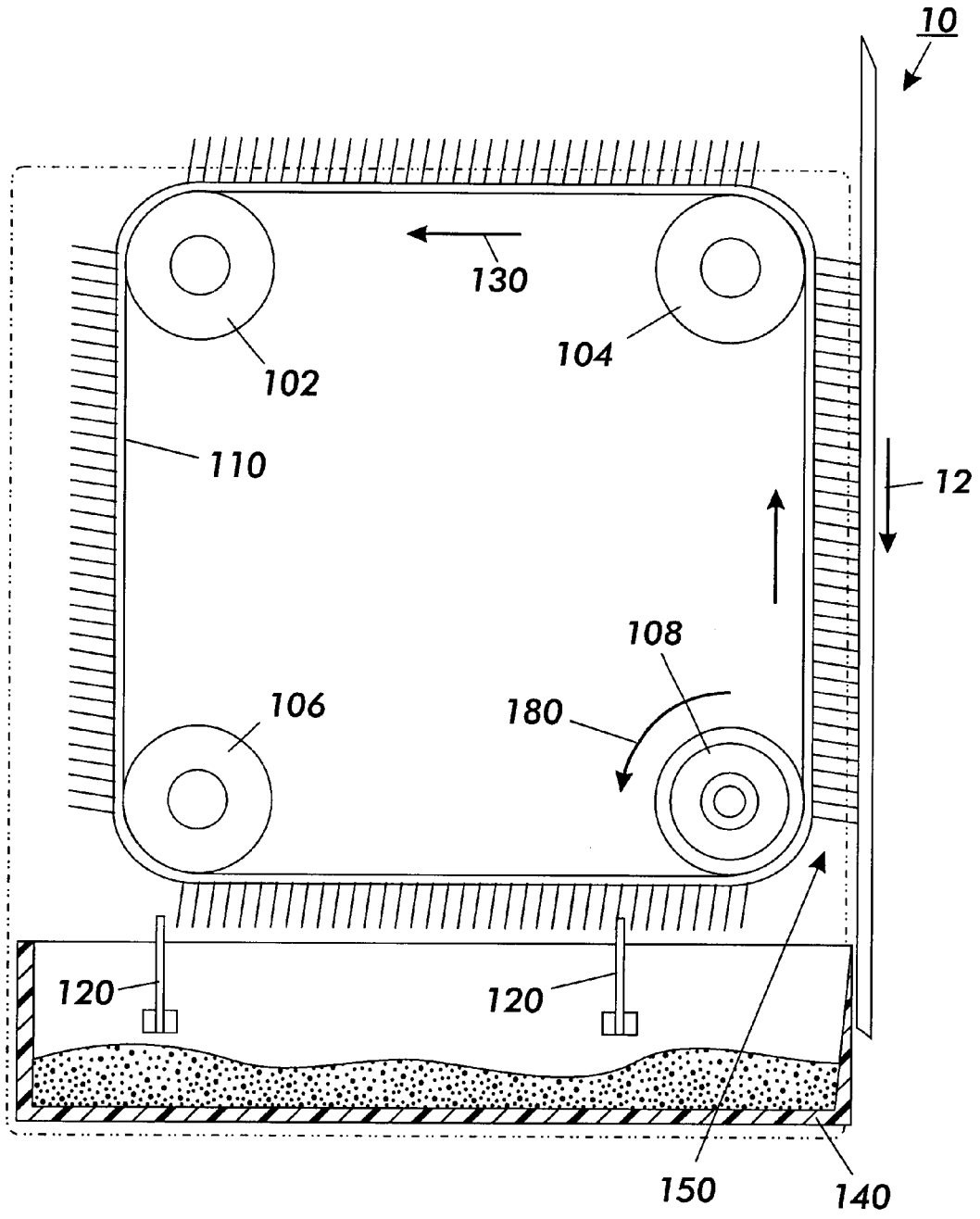
FIG. 2 is an elevational view of the present invention.
Figure 3:
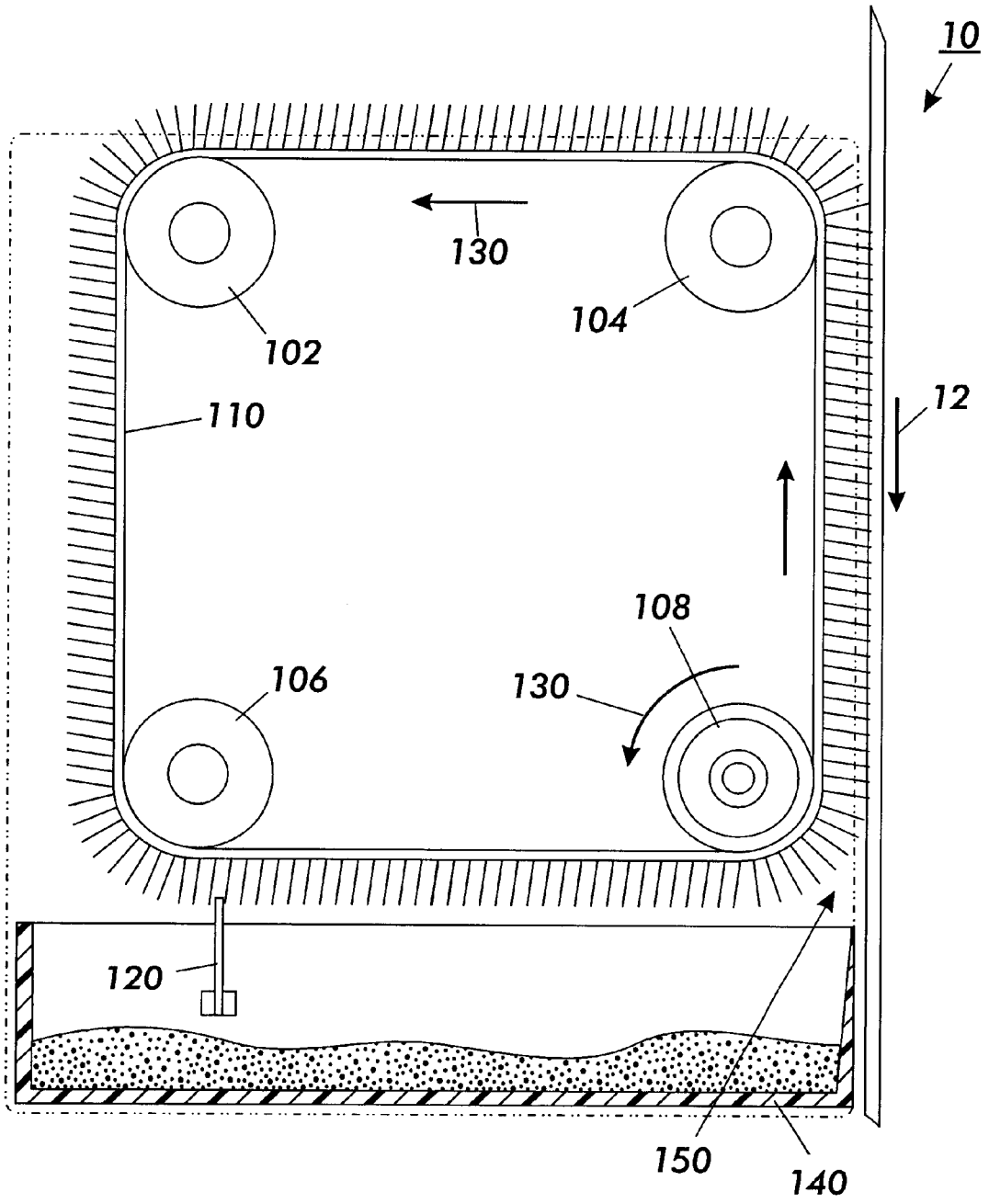
FIG. 3 is an elevational view of another embodiment of the present invention.
Figure 4:
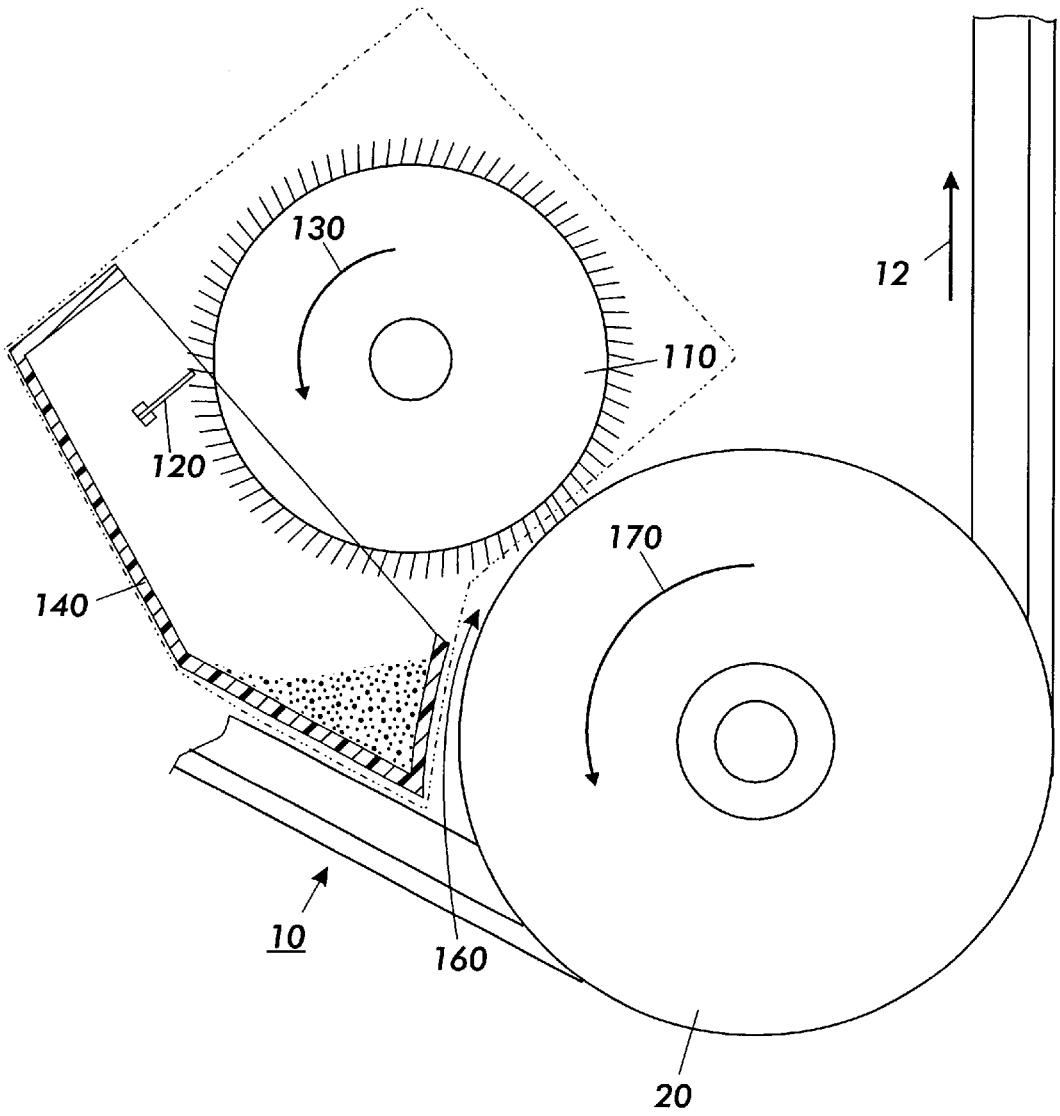
FIG. 4 is an elevational view of still another embodiment of the present invention All references cited in this specification, and their references, are incorporated by reference herein where appropriate for teaching additional or alternative details, features, and/or technical background.

As thus described, a reproduction machine in accordance with the present invention may be any of several well-known devices. Variations may be expected in specific electrophotographic processing, paper handling and control arrangements without effecting the present invention. However, it is believed that the foregoing description is sufficient for purposes of the present application to illustrate the general operation of an electrophotographic printing machine, which exemplifies one type of apparatus employing the present invention therein. Reference is now made to FIGS. 2–4, where the showings are for the purpose of illustrating preferred embodiments of the present invention and not for limiting the same.

Wear debris accumulates on the back side of the photoreceptor belt and the drive roller as the result of movement of the photoreceptor belt over the backer bars and rollers supporting the photoreceptor bell Adhesion of the debris to the back of the belt is low because there is a low triboelectric relationship between the particles and the back of the photoreceptor belt. Therefore, a minimal charge is developed as the particles rub against the backer bars and rollers supporting the photoreceptor belt. Removal of such debris adhered to the back side of a dielectric surface can be accomplished by mechanical, electrical or electromechanical means. The belt brush cleaner of the present invention employs a combination of electrical and mechanical forces to detach and remove debris from the back side of the photoreceptor belt.

Reference is now made to FIG. 2, which shows an elevational view of one embodiment of the present invention. The flexible belt brush 110 is shown in operable condition in contact with the backside of photoreceptor belt 10 through cleaning nip 150. Flexible belt brush 110 is electrically biased to suitable magnitude and polarity and is comprised of a continuous loop of conductive backing material (e.g. urethane, polycarbonate or polyester) to which conductive brush fibers are attached with conductive glue in segments, to form a segmented belt brush The flexible belt brush 110 is entrained about four rollers 102, 104, 106 and 108, one of which is a drive roller, and moving in direction 130 opposed to the movement of photoreceptor belt 10. The two rollers 102 and 104 support the belt 110 in brushing contact with photoreceptor belt 10. The third and fourth rollers 106 and 108 support belt 110 as the conductive brush fibers are brought into contact with flicker bars 120, which engage the fibers of the brush belt as the fibers move past the flicker bars. As the fibers rebound from contact with the flicker bars 120, the fibers release debris particles, which fall into waste chamber 140. Coupled to the drive roller is a drive means which indexes the belt brush segmentally in direction 180 as the fiber segment contacting the backside of the photoreceptor belt becomes saturated with debris particles. Although entraining the belt brush about four rollers is suitable for many applications, it is understood that some applications may require an alternate number of support rollers. Such alternate plurality of support rollers is included within the spirit and scope of the present invention as defined by the appended claims.

In order to exert an electrostatic force on the debris particles, which may develop a low triboelectric charge as the debris particles rub against the back side of the photoreceptor belt and the supporting rollers and backer bars, an electric potential is applied to the conductive fibers of the brush belt. This potential creates an electric field between the fibers and the ground plane of the photoreceptor belt. The force experienced by the debris particles must exceed the small adhesion force between the debris particles and the backside of the photoreceptor belt in order to detach the particles. The electrical force, when combined with the mechanical (deflection) forces of the fibers, detaches and removes slightly charged debris particles from the backside of the photoreceptor belt.

Reference is now made to FIG. 3, which shows an alternate embodiment of the present invention. As in the previous embodiment, the flexible belt brush 110 is shown in operable condition in contact with the backside of photoreceptor belt 10 through cleaning nip 150. Flexible belt brush 110 is electrically biased to suitable magnitude and polarity and is comprised of a continuous loop of conductive backing material (e.g. urethane, polycarbonate or polyester) to which conductive brush fibers are attached with conductive glue to form an endless brush belt. The flexible belt brush 110 is entrained about four rollers 102, 104, 106 and 108, one of which is a drive roller, and moving in direction 130 opposed to the movement of photoreceptor belt 10. The two rollers 102 and 104 support the belt 110 in brushing contact with photoreceptor belt 10. The third and fourth rollers 106 and 108 support belt 110 as the conductive brush fibers are brought into contact with flicker bar 120, which engages the fibers of the brush belt as the fibers move past the flicker bar. As the fibers rebound from contact with the flicker bar 120, the fibers release debris particles, which fall into waste chamber 140. Coupled to the drive roller is a drive means, which continuously rotates the drive roller to move the belt brush in direction 130. Although entraining the belt brush about four rollers is suitable for many applications, it is understood that some applications may require an alternate number of support rollers. Such alternate plurality of support rollers is included within the spirit and scope of the present invention as defined by the appended claims.

As may be appreciated by one skilled in the art, the embodiments illustrated in FIGS. 2 and 3 may also be configured to remove debris particles accumulating on drive roller 20, which supports photoreceptor belt 10, or on other surfaces which contact the backside of photoreceptor belt 10. Reference is now made to FIG. 4, which illustrates the a third embodiment of the present invention configured to remove debris particles from drive roller 20, as an example of one such configuration. As shown in FIG. 4, the cylindrical belt brush 110 is in operable contact with drive roller 20 through cleaning nip 160. The cylindrical brush 110 is electrically biased to suitable magnitude and polarity and is comprised of a backing material to which conductive brush fibers are attached, and a cylindrical core, which may be solid or tubular. Coupled to the cylindrical core is a drive means, which continuously rotates the cylindrical brush 110. The cylindrical brush 110 rotates in direction 130, opposed to the movement of drive roller 20, which rotates in direction 170, and is in brushing contact with drive roller 20 through cleaning nip 160. As cylindrical brush 110 rotates, the conductive brush fibers are brought into contact with flicker bar 120, which engages the fibers of the cylindrical brush as the fibers move past flicker bar 120. As the fibers rebound from contact with the flicker bar 120, the fibers release debris particles, which fall into waste chamber 140.

It is therefore apparent that there has been provided, in accordance with the present invention, a brush belt for removing electrostatically charged particles from a surface that fully satisfies the aims and advantages set forth hereinabove. While this invention has been described in conjunction with specific embodiments thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

What is claimed:

1. An apparatus for removing particles from a non-image-bearing surface, the surface including a non-image-bearing surface opposed from an image-bearing surface of an image-bearing belt or a drive roller, comprising:

a member including a substrate and a multiplicity of conductive fibers extending outwardly therefrom with the fibers contacting the surface for removal of particles therefrom;

a supporting device for movably supporting said member in contact with the surface;

means for removing particles from said member to ensure sufficient cleaning of said member; and means for electrically biasing said member.

2. The apparatus according to claim 1, wherein said member includes a brush belt.

3. The apparatus according to claim 2, wherein said supporting device comprises a plurality of supports having said brush belt entrained thereabout.

4. The apparatus according to claim 3, wherein said supporting device further comprises indexing means operatively associated with said supporting device to incrementally advance said brush belt to move clean conductive fibers into contact with the surface being cleaned.

5. The apparatus according to claim 3, wherein said supporting device further comprises drive means operatively associated with said supporting device to continually advance said brush belt to move clean conductive fibers into contact with the surface being cleaned.

6. The apparatus according to claim 1, wherein said means for removing particles comprises:

a flicker bar in contact with the fibers of said member to remove particles therefrom;

means for collecting the particles removed from said member.

7. The apparatus according to claim 1, wherein said member comprises a cylindrical brush with said cylindrical brush affixed about a cylindrical core.

8. The apparatus according to claim 7, wherein said supporting device further comprises drive means operatively associated with said supporting device, to continually advance said cylindrical brush to move clean conductive fibers into contact with the surface being cleaned.

9. A printing machine of the type having a photoconductive member in the form of an endless dielectric belt entrained about a supporting structure including a drive roller, wherein the improvement comprises:

a cleaning member, including a substrate and a multiplicity of conductive fibers extending outwardly therefrom with the fibers contacting a non-image-bearing surface, the surface including a non-image-bearing surface opposed from an image-bearing surface of an image-bearing belt or a drive roller, to be cleaned within the printing machine;

a supporting device for movably supporting said cleaning member in contact with said surface;

means for removing particles from said cleaning member to ensure sufficient cleaning of said cleaning member; and means for electrically biasing said cleaning member.

10. The apparatus according to claim 9, wherein the cleaning member comprises a brush belt having a substrate and a multiplicity of conductive fibers extending outwardly therefrom with the fibers contacting the surface for removal of particles therefrom.

11. The apparatus according to claim 9, wherein said supporting device for movably supporting said cleaning member comprises a plurality of supports having said cleaning member entrained thereabout.

12. The apparatus according to claim 11, wherein said supporting device for movably supporting said cleaning member further comprises indexing means operatively associated with said supporting device for movably supporting said cleaning member to incrementally advance said cleaning member to move clean conductive fibers into contact with the surface being cleaned.

13. The apparatus according to claim 11, wherein said supporting device for movably supporting said cleaning member further comprises drive means operatively associated with said supporting device for movably supporting said cleaning member to continually advance said cleaning member to move clean conductive fibers into contact with the surface being cleaned.

14. The apparatus according to claim 9, wherein said means for removing particles comprises:

a flicker bar; and means for collecting debris removed from the surface.

15. The apparatus according to claim 9, wherein said supporting device for movably supporting said cleaning member comprises a cylindrical core, said cleaning member affixed about said cylindrical core.

16. The apparatus according to claim 15, wherein said supporting device for movably supporting said cleaning member further comprises drive means operatively associated with said supporting device, to continually advance said cleaning member to move clean conductive fibers into contact with the surface being cleaned.

* * * * *